United States Patent [19]

Hwa

[11] 4,098,720

[45] Jul. 4, 1978

[54] CORROSION INHIBITION

[75] Inventor: Chih M. Hwa, Arlington Heights, Ill.

[73] Assignee: Chemed Corporation, Cincinnati, Ohio

[21] Appl. No.: 649,126

[22] Filed: Jan. 14, 1976

Related U.S. Application Data

[63] Continuation of Ser. No. 409,513, Oct. 25, 1973, abandoned, which is a continuation of Ser. No. 169,483, Aug. 5, 1971, abandoned.

[51] Int. Cl.[2] ..... C23G 11/16; C23G 11/18

[52] U.S. Cl. ..... 252/389 R; 21/2.5 R; 21/2.7 R; 106/14.14; 106/14.17; 208/47; 252/181; 252/387; 252/390

[58] Field of Search ..... 252/389 R, 387, 390, 252/181; 21/2.7 R, 2.5 R; 208/47; 106/14; 210/58

[56] References Cited

U.S. PATENT DOCUMENTS

| | | | |
|---|---|---|---|
| 2,877,188 | 3/1959 | Liddell | 252/389 R |
| 2,941,953 | 6/1960 | Hatch | 252/389 R |
| 3,272,736 | 9/1966 | Petro et al. | 252/387 |
| 3,340,001 | 9/1967 | Thornhill | 252/389 R |
| 3,425,954 | 2/1969 | Ruzevick et al. | 252/390 |
| 3,553,137 | 1/1971 | Woods | 252/389 R |
| 3,578,589 | 5/1971 | Hwa | 21/2.7 R |

*Primary Examiner*—Benjamin R. Padgett
*Assistant Examiner*—Irwin Gluck
*Attorney, Agent, or Firm*—Charles L. Harness

[57] ABSTRACT

Low toxicity, low pollution potential compositions and methods for inhibiting corrosion of ferrous and non-ferrous metallic parts in aqueous systems. The compositions have no chromate, no polyphosphate and no borate and consist essentially of alkali metal nitrite, alkali metal carbonate or bicarbonate and an azole. Preferably the compositions also include an alkali metal silicate and small amounts of an alkali metal hydroxide. In the corrosion inhibiting method, the aforesaid compositions are added to the system water in amounts sufficient to provide from about 100 to 10,000 parts per million ("ppm") of alkali metal nitrite, the primary inhibitor.

9 Claims, No Drawings

CORROSION INHIBITION

This application is a continuation of U.S. Ser No. 409,513, filed Oct. 25, 1973, now abandoned, which is in turn a continuation of U.S. Ser. No. 169,483, filed Aug. 5, 1971, now abandoned.

This invention relates to corrosion inhibiting compositions and methods. In particular, the invention relates to compositions and methods for inhibiting corrosion of metal parts in heat exchangers employing aqueous solutions, for example in the cooling systems of diesel engines.

Metals or metallic parts commonly found in cooling systems of diesel engines and in other heat exchangers or fluid conduits include steel, aluminum, brass, copper, cast iron and solder; all of which are subject to varied forms of corrosive attack from aqueous fluids in contact therewith. The prior art suggests a wide variety of corrosion inhibiting materials or compositions to alleviate such attacks. Sodium nitrite - sodium tetraborate - benzotriazole compositions such as those disclosed in Liddell - U.S. Pat. No. 2,877,188 (Mar. 10, 1959) and in Hatch — U.S. Pat. No. 3,335,096 (Aug. 8, 1967) have been used for some time. Green et al — U.S. Pat. No. 2,815,328 (Dec. 3, 1957) discloses similar compositions containing in addition nitrate, silicate and a base to provide solution pH of 8.5 to 10. Thornhill et al — U.S. Pat. No. 3,340,001 (Sept. 5, 1967) discloses corrosion inhibiting compositions consisting of nitrate, nitrate, an azole and an alkali metal silicate, cyanate or urea. In the past, chromates and polyphosphates have also been widely used to inhibit corrosion of metals in contact with water or other aqueous fluids.

There are a number of problems and disadvantages associated with the known corrosion inhibiting compositions and methods. The chromates are highly toxic. This is undesirable both from the viewpoint of the health of handling personnel and also because of the problem of waste disposal. Polyphosphates are non-toxic. However, due to the hydrolysis of polyphosphates to orthophosphates and the limited solubility of calcium orthophosphate which is likely to form, it has not been possible in many instances to maintain adequate concentrations of phosphates. This reversion process of polyphosphates also can create sludge formation and/or scale deposition problems in the system. From a water pollution standpoint, effluent containing a sufficiently high phosphate residual may serve as a nutrient to aquatic life. For these reasons, the use of polyphosphates has not been entirely satisfactory. Extensive data on boron in both well and surface waters in North America show that the amount of boron normally present is less that 1 ppm. The ingestion of large quantities of boron can affect the central nervous system and prolonged ingestion may result in a clinical syndrome known as borism. Boron is an essential element to plant growth, but is toxic to many plants at concentrations as low as 1 ppm. In a report entitled "Water Quality Criteria," to the U.S. Secretary of the Interior, by the Federal Water Pollution Control Administration, Washington, D.C., on Apr. 1, 1968, a limit of 0.05 ppm for hexavalent chromium and 1.0 ppm for boron in public water supplies was established.

It is an object of this invention to overcome the prior art problems. It is a specific object to provide relatively non-toxic, completely phosphate-free, chromate-free and borate-free compositions and processes for inhibiting corrosion in aqueous systems. Still further objects and advantages will be apparent from the following more detailed description.

In accordance with the present invention, a corrosion inhibiting composition is provided consisting essentially of the following materials in the amounts shown:

| Ingredient | Weight Percent (Active dry-Weight basis) Operable | Preferred |
|---|---|---|
| Alkali metal nitrite | 4 to 80 | 40 to 60 |
| Azole compound | 0.1 to 10 | 1.5 to 6 |
| Alkali metal carbonate | 2 to 60 | 20 to 40 |
| Alkali metal silicate | 0.1 to 30 | 6 to 12 |
| Alkali metal hydroxide | 0.1 to 20 | 2 to 6 |
| Acrylic polymer | 0 to 10 | 0.01 to 3 |

The composition is completely free of any phosphate, chromate or borate. It is not only relatively non-toxic, but also has very low pollution potential.

In the method of this invention, the aqueous fluid to be rendered less corrosive is treated with sufficient amounts of the composition described above to provide at least about 100 ppm. and preferably from about 1000 to about 4000 ppm. (for example, 2000 ppm.) of the primary nitrite inhibitor, expressed as sodium nitrite ($NaNO_2$). In other words, the method comprises maintaining in the aqueous fluid in contact with the metal parts susceptible to corrosion the following concentrations of the essential or preferred corrosion inhibiting materials:

| Ingredient | Corrosion Inhibiting Concentration in parts per million (ppm.) Minimum | Preferred | Optimum |
|---|---|---|---|
| Alkali metal nitrite (as $NaNO_2$) | 100 ppm. | 1000 to 4000 ppm. | 2000 ppm. |
| Azole compound (as such) | 10 ppm. | 60 to 800 ppm. | 400 ppm. |
| Alkali metal carbonate (as such) | 200 ppm. | 1000 to 2400 ppm. | 1600 ppm. |
| Alkali metal silicate (as such) | 10 ppm. | 80 to 1200 ppm. | 600 ppm. |
| Alkali metal hydroxide (as such) | 10 ppm. | 80 to 1200 ppm. | 300 ppm. |
| Acrylic polymer (as the sodium salt) | 0 ppm. | 2 to 600 ppm. | 10 ppm. |

In practice it will be found that dosages of a 25 percent active aqueous solution of the composition described above in the range of from about 0.5 to about 5 fluid ounces per gallon of the aqueous fluid to be treated will provide the requisite concentration of the corrosion inhibiting ingredients. Typical preferred dosages for such 25 percent active inhibitor solutions are about 1 to 2 fluid ounces per gallon.

Typical industrial applications in which the present invention may be employed are cooling water treatment; radiator coolants, hydraulic liquids, anti-freeze compositions, heat transfer media and petroleum well treatments.

The term "alkali metal" as used herein means the metals of Group 1A of the Periodic Table of the Elements. The preferred alkali metal compounds used are the sodium or potassium nitrites, carbonates, hydroxides and silicates. The alkali metal silicates used are those having the formula $M_2O.(SiO_2)_n$ where M represents the alkali metal and $n$ is a number of from 0.5 to 4.5, preferably from 1.6 to 3.6, and most preferably from about 2.9 to about 3.3. The silicates are preferably used in the commercially available form known as liquid alkali metal silicates. One suitable liquid sodium silicate is commercially available from E. I. duPont de Nemours & Co., Wilmington, Delaware under the trade designation "DuPont's Grade F." According to the manufacturer, this product has the following properties:

| | |
|---|---|
| Weight ratio of $SiO_2$ to $Na_2O$ | 3.25 |
| Content of $SiO_2$ | 28.40% ∓ 0.5% |
| Content of $Na_2O$ | 8.70 % ∓ 0.2% |
| Specific Gravity at 60° F | 40.6° Baume |
| Viscosity at 68° F | 160 ∓ 40 centipoises |
| Approximate Density at 60° F | 11.6 pounds per gallon |

Azoles are nitrogen containing heterocyclic 5-membered ring compounds, and azoles which are suitable in the composition of this invention include triazoles, pyrazoles, imidazoles, isoxazoles, oxazoles, isothiazoles, thiazoles and mixtures thereof as disclosed in U.S. Pat. Nos. 2,618,608, 2,742,369 and 2,941,953.

The triazoles which can be employed in the composition of this invention are any water-soluble 1,2,3-triazoles such as 1,2,3-triazole itself having the formula

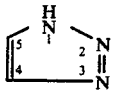

or an N-alkyl substituted 1,2,3-triazole, or a substituted water soluble 1,2,3-triazole where the substitution takes place in the 4- and/or 5-position of the triazole ring. The preferred 1,2,3-triazole is benzotriazole (sometimes known as 1,2,3-benzotriazole) having the structural formula:

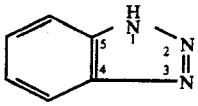

Other suitable water soluble derivatives include, for example, 4-phenyl-1,2,3-triazole; 1,2-naphthotriazole; 4-nitrobenzotriazole; 1,2,3-tolyltriazole; 4-methyl-1,2,3-triazole; 4-ethyl-1,2,3-triazole; 5-methyl-1,2,3-triazole; 5-ethyl-1,2,3-triazole; 5-propyl-1,2,3-triazole; 5-butyl-1,2,3-triazole; and the like.

The pyrazoles which can be used in the composition of this invention include any water-soluble pyrazoles such as pyrazole itself or a substituted pyrazole where the substitution takes place in the 3, 4, or 5 position (or several of these positions) of the pyrazole ring as shown by the structural formula:

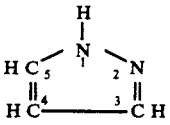

Suitable pyrazoles include pyrazole; 3,5-dimethyl pyrazole, 6-nitroindazole; 4-benzyl pyrazole; 4,5-dimethyl pyrazole, 3-allyl pyrazole, and the like.

The imidazoles which can be used in the composition of this invention include any water-soluble imidazoles such as imidazole itself or a substituted imidazole where the substitution takes place in the 2, 4 or 5 position (or several of these positions) of the imidazole ring as shown by the structural formula:

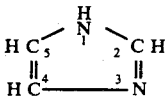

Suitable imidazoles which can be employed in the composition of this invention include imidazole; adenine; guanine; benzimidazole; 5-methyl benzimidazole; 2-phenyl imidiazole; 2-benzyl imidazole; 4-allyl imidazole; 4-(betahydroxyethyl)-imidazole; purine; 4-methyl imidazole; xanthine; hypoxanthene; 2-methyl imidazole; and the like.

Isoxazoles which can be employed in the composition of this invention include any water-soluble isoxazole such as isoxazole itself or a substituted isoxazole where the substitution takes place in the 3, 4, or 5 position (or several of these positions) of the isoxazole ring as shown by the structural formula:

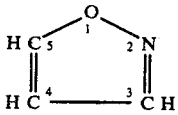

Suitable isoxazoles include isoxazole, 3-mercaptoisoxazole, 3-mercaptobenzisoxazole, benzisoxazole, and the like.

The oxazoles which can be employed in the composition of this invention include any water-soluble oxazoles such as oxazole itself or a substituted oxazole where the substitution takes place in the 2, 4 or 5 position (or several of these positions) of the oxazole ring as shown here by the structural formula:

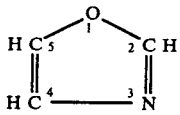

Suitable oxazoles include oxazole, 2-mercaptoxazole, 2-mercaptobenzoxazole, and the like.

The isothiazoles which can be employed in the process of this invention include any water-soluble isothiazoles such as isothiazole itself or a substituted isothiazole where the substitution takes place in either the 3, 4 or 5 position (or several of these positions) of the isothiazole ring as shown by the structural formula:

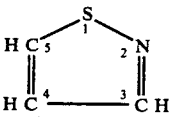

suitable isothiazoles include isothiazole, 3-mercaptoisothiazole, 3-mercaptobenzisothiazole, benzisothiazole, and the like.

The thiazoles which can be used in the composition of this invention include any water-soluble thiazole such as thiazole itself or a substituted thiazole where the substitution takes place in the 2, 4 or 5 position (or several of these positions) of the thiazole ring as shown here by the structural formula:

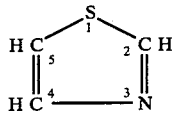

Suitable thiazoles include thiazole, 2-mercaptothiazole, 2-mercaptobenzothiazole, benzothiazole, and the like.

In the above azole compounds, the constituents substituted in the azole rings can be alkyl, aryl, aralkyl, alkylol, and alkenyl radicals so long as the substituted azole is water-soluble in the aqueous system in which the corrosion inhibiting composition is ultimately used at the ultimate use concentration.

The preferred azoles for the present compositions are benzotriazole and mercaptobenzothiazole, and these are preferably used in the form of their water soluble alkali metal (e.g., sodium) salts. It will be obvious that other water soluble salts may also be used if desired.

As noted, the composition of this invention may also contain minor amounts of a water-soluble acrylic polymer. Such polymers may have a molecular weight of from 200 to 15,000,000 and include those having repeated groups with the formula:

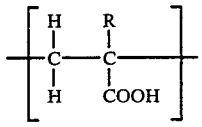

wherein R is hydrogen or a methyl group. Water-soluble salts or esters of the acrylic polymers are also suitable.

Suitable polymers for use in this invention are the polymers of acrylic or methacrylic acid and their derivatives, for example, acrylic acid, the alkali metal and ammonium salts of acrylic acid, esters of acrylic acid with lower ($C_1$ to $C_4$) alkanols, methacrylic acid, the alkali metal and ammonium salts of methacrylic acid, esters of methacrylic acid with lower ($C_1$ to $C_4$) alkanols, and copolymers of these acids and derivatives with each other. Such polymers include, for example, polyacrylic acid, ammonium polyacrylate, sodium polyacrylate, ammonium polymethacrylate, guanidinium polyacrylate, dimethylaminoethyl polymethacrylate, methacrylic acid-dimethylaminoethyl methacrylate copolymer, acrylic acid-methacrylic acid copolymer, and the like. The preferred polymers are polyacrylic acid, polymethacrylic acid, or water-soluble salts of these polymers having a molecular weight within the range of from 1000 to 200,000, calculated as the free acid, e.g., polyacrylic acid.

The compositions of this invention inhibit corrosion of ferrous and non-ferrous metals (inlcuding, for example, aluminum, tin, copper, copper alloys, lead, solder alloys and the like.) They are effective as corrosion inhibitors in closed recirculating water systems, at either high or low temperatures. The compositions may be used in hot or chilled water systems, hot water and steam heating boiler systems and in diesel and other internal combustion gasoline engine jacket systems. The compositions are compatible with both permanent type anti-freeze solutions and commonly used alcohols, and provide excellent corrosion control of water jackets, pumps, heat exchange surfaces and other components of closed systems. The compositions may be sold and used in the form of a dry powder or briquette or in the form of an aqueous solution containing from 50 to 95 percent by weight of water.

The invention will be further understood from the following specific, but non-limiting, examples. In the examples and elsewhere in the description, all parts are parts by weight unless otherwise specifically indicated.

EXAMPLE 1

In this example the corrosion inhibiting composition was prepared as an aqueous concentrate containing

| | Weight Percent |
|---|---|
| Demineralized water | 74.6 |
| Potassium hydroxide (flake) | 0.7 |
| Potassium carbonate (anhydrous) | 7.0 |
| Sodium mercaptobenzothiazole | 0.7 |
| Liquid sodium silicate* | 5.3 |
| Sodium nitrite | 11.7 |

*DuPont's "Grade F" liquid sodium silicate

In order to demonstrate the corrosion inhibiting efficacy of this concentrate, 165 milliliters of a test solution consisting of distilled water containing 100 ppm. of chloride ion ($Cl^-$), sulfate ion ($SO_4^{--}$) and of bicarbonate ion ($HCO_3^-$), each introduced as the sodium salt, was poured into a 300 milliliter beaker. The corrosion inhibiting concentrate was added to the test solution in an amount corresponding to 1.14 fluid ounces per gallon. Cleaned and weighed test specimens of cast iron, mild steel, copper, brass, and a 30 percent tin/70 percent lead solder were placed in the beaker, which was then closed with a rubber stopper fitted with a condenser return and an aerator assembly. The beaker is then placed in an oil bath maintained at 160° F and the test conducted at an aerator flow rate of 100 milliliters per minute for a total test period of 336 hours. The volume of the test solution was maintained substantially constant by periodic additions of distilled water. At the conclusion of the test, the metal test specimens are removed, cleaned and dried and corrosion rates are determined by the weight loss.

The results of this test are shown in the following Table I. For comparison, results are also shown for a blank run (no corrosion inhibitor added) conducted under identical conditions.

TABLE I

| | | Corrosion Rate in Mils per Year for | | | | |
|---|---|---|---|---|---|---|
| Run | Additive | Cast Iron | Mild Steel | Copper | Brass | Solder |
| A | None (blank run) | 35.1 | 14.1 | 0.2 | 0.1 | 13.9 |
| B | 1.14 fluid ounces of the concentrate of Example I per gallon of test solution | 0.4 | 0.3 | 0.2 | 0.1 | 1.0 |

EXAMPLES 2-6

Similar corrosion inhibiting properties are obtained with the following composition:

EXAMPLE 2

Aqueous Concentrate

| | Weight Percent |
|---|---|
| Water | 90.6 |
| Sodium hydroxide | 0.3 |
| Sodium carbonate | 2.5 |
| Benzotriazole | 0.6 |

-continued

| | Weight Percent |
|---|---|
| Sodium metasilicate | 2.0 |
| Sodium nitrite | 4.0 |

EXAMPLES 3–6

Solid Compositions

| | Weight Percent | | | |
|---|---|---|---|---|
| | Ex. 3 | Ex. 4 | Ex. 5 | Ex. 6 |
| Sodium carbonate | 29.0 | — | 45.0 | 40.0 |
| Potassium carbonate | — | 40.0 | — | — |
| Sodium hydroxide | 1.0 | — | — | — |
| Mercaptobenzothiazole | 3.0 | — | 5.0 | — |
| Benzotriazole | — | 2.0 | — | — |
| Tolyltriazole | — | — | — | 0.3 |
| Sodium nitrite | 60.0 | 58.0 | — | 50.0 |
| Potassium nitrite | — | — | 50.0 | — |
| Sodium metasilicate pentahydrate | 7.0 | — | — | 9.7 |

EXAMPLE 7

Another liquid concentrate of a corrosion inhibiting composition according to the present invention has the following formula:

| | Weight Percent |
|---|---|
| Demineralized water | 73.56 |
| Potassium hydroxide (flake) | 0.8 |
| Potassium carbonate (anhydrous) | 7.0 |
| Sodium mercaptobenzothiazole (50% solution) | 1.6 |
| Liquid sodium silicate (DuPont's Grade F) | 5.3 |
| Sodium nitrite | 11.7 |
| Sodium polymethacrylate (25% solution - molecular weight about 10,000, as the free acid) | 0.04 |

This composition has a pH of about 11.7 and a freezing point of about 8° F. The corrosion inhibiting efficacy of this composition was tested at a dosage of 2 fluid ounces per gallon in the test described in Example 1 for 200 hours at 190° F. with aeration. The test water was Chicago tap water to which 100 ppm. chloride ion ($Cl^-$), sulfate ion ($SO_4^{--}$) and bicarbonate ion ($HCO_3^-$) had been added prior to the test. The results are shown in Table II.

Table II

| Metal Test Specimen | Weight Loss in 200 hours (milligrams per square inch) |
|---|---|
| Cast Iron | 0.0 |
| Steel | 0.08 |
| Copper | 0.7 |
| Yellow Brass (70% Copper, 30% Zinc) | 0.6 |
| Red Brass (85% Copper, 15% Zinc) | 0.8 |
| Solder (70% Lead, 30% Tin) | 3.0 |

The composition of this example provides corrosion inhibition in diesel and other internal combustion engines, in hot water heating systems and chilled water circuits. It does not adversely affect non-metal components or seals. Typical dosages are 2 fluid ounces per gallon of system water (approximately 1½ gallons per 100 gallons of system capacity). In use, inhibiting strength is regulated by maintaining a minimum of 100 ppm. and preferably from about 1000 to about 4000 ppm. of the primary nitrite inhibitor, as sodium nitrite ($NaNO_2$). In the treatment of internal combustion engines, it is preferable to use premixed solutions of make-up water and the above concentrate to best assure proper treatment level to the jacket water; however, the concentrate may be added directly to the engine cooling system if necessary or desirable. In chilled and hot water systems, the concentrate may be added directly to closed recirculating waters by pumping from the shipping container or by use of by-pass feeders or any other means suitable for assuring complete system distribution at the desired dosage level.

What is claimed is:

1. A corrosion inhibiting composition free of any polyphosphate, chromate and borate and consisting essentially of:

| | Weight Percent based on total weight, dry weight basis |
|---|---|
| Alkali metal nitrite | 4 to 80 |
| Alkali metal carbonate | 2 to 60 |
| Water-soluble mercaptobenzothiazole compound | 0.1 to 10 |
| Alkali metal hydroxide | 0.1 to 20 |
| Alkali metal silicate | 0.1 to 30 |

2. Composition as defined in claim 1 containing 40 to 60 percent nitrite, 20 to 40 percent carbonate, 1.5 to 6 percent mercaptobenzothiazole compound, 2 to 6 percent hydroxide and 6 to 12 percent silicate.

3. Composition as defined in claim 2 wherein the nitrite is sodium nitrite.

4. Composition as defined in claim 3 wherein the mercaptobenzothiazole compound is sodium mercaptobenzothiazole.

5. Composition as defined in claim 4 further including from 0.01 to 10 weight percent of a water-soluble acrylic polymer having a molecular weight of from about 200 to 15,000,000 and repeated groups with the formula:

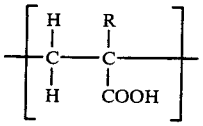

wherein R is hydrogen or a methyl group, or a water-soluble salt or ester of such polymer.

6. Method for inhibiting corrosion of metallic parts in contact with an aqueous fluid comprising maintaining in the said fluid sufficient amounts of the composition of claim 1 to provide at least about 100 ppm. of nitrite, as sodium nitrite.

7. Method for inhibiting corrosion of metallic parts in contact with an aqueous fluid comprising maintaining in the said fluid sufficient amounts of the composition of claim 4 to provide at least about 100 ppm. of nitrite, as sodium nitrite.

8. Method for inhibiting corrosion of metallic parts in contact with an aqueous fluid comprising maintaining in the said fluid sufficient amounts of the composition of claim 5 to provide at least about 100 ppm. of nitrite, as sodium nitrite.

9. Method of claim 6 wherein the sodium nitrite concentration is from about 1000 to about 4000 ppm.

* * * * *